US008636397B2

(12) United States Patent
Kiesel

(10) Patent No.: US 8,636,397 B2
(45) Date of Patent: Jan. 28, 2014

(54) VEHICLE HEADLAMP WITH A LENS HAVING ELEMENTS FORMED ON A BOUNDARY SURFACE THEREFOR

(75) Inventor: Markus Kiesel, Reutlingen (DE)

(73) Assignee: Automotive Lighting Reutlingen GmbH (DE)

( * ) Notice: Subject to any disclaimer, the term of this patent is extended or adjusted under 35 U.S.C. 154(b) by 322 days.

(21) Appl. No.: 12/775,808

(22) Filed: May 7, 2010

(65) Prior Publication Data

US 2010/0284197 A1 Nov. 11, 2010

(30) Foreign Application Priority Data

May 9, 2009 (DE) ..... 10 2009 020 593

(51) Int. Cl.
*F21V 5/00* (2006.01)

(52) U.S. Cl.
USPC ..... 362/522; 362/520; 362/311.01; 362/338; 362/539

(58) Field of Classification Search
USPC ..... 362/520, 333–337, 338, 309, 308, 362/311.01–311.1, 539, 522
See application file for complete search history.

(56) References Cited

U.S. PATENT DOCUMENTS

| | | | | |
|---|---|---|---|---|
| 4,868,726 | A * | 9/1989 | Segoshi | 362/308 |
| 5,836,674 | A * | 11/1998 | Nishitani et al. | 362/336 |
| 7,025,483 | B2 * | 4/2006 | Albou | 362/538 |
| 7,441,927 | B1 * | 10/2008 | Kling | 362/297 |
| 8,414,170 | B2 * | 4/2013 | Erward et al. | 362/520 |
| 2004/0001343 | A1 | 1/2004 | Albou | |
| 2008/0247188 | A1 * | 10/2008 | Woodward | 362/554 |

FOREIGN PATENT DOCUMENTS

| | | | |
|---|---|---|---|
| AT | 008 253 | U1 | 4/2006 |
| DE | 10 2007 014 676 | A1 | 4/2007 |
| FR | 2 770 617 | A1 | 10/1997 |
| JP | 11329008 | A | 11/1999 |

* cited by examiner

*Primary Examiner* — Robert May
(74) *Attorney, Agent, or Firm* — Donald R. Boys; Central Coast Patent Agency, Inc.

(57) ABSTRACT

There is presented a vehicle headlamp with an imaging optics that is designed to project, as light/dark boundary, into the area in front of the vehicle headlamp, an edge that delimits a light flux of a light source of the vehicle headlamp, a boundary surface of a component of the imaging optics, through which the light flux penetrates, having an overhead element in the form of a local deformation of the boundary surface having a prismatic effect by means of which the light is deflected into an overhead area lying over the light/dark boundary. The vehicle headlamp is distinguished by the fact that the boundary surface has more than one hundred overhead elements distributed discretely over the boundary surface.

19 Claims, 5 Drawing Sheets

VEHICLE HEADLAMP WITH A LENS HAVING ELEMENTS FORMED ON A BOUNDARY SURFACE THEREFOR

CROSS-REFERENCE TO RELATED APPLICATIONS

The present application claims priority to German patent application serial number 10 2009 020 593.4, which was filed on May 9, 2009, which is incorporated herein in its entirety, at least by reference.

BACKGROUND OF THE INVENTION

1. Field of the Invention

The present invention relates to a vehicle headlamp according to the preamble of claim 1. Such a vehicle headlamp is disclosed in utility model G 90 00 395.

2. Description of Related Art

Specific location-dependent illuminances are required for vehicle headlamps in the SAE legal sphere. These are prescribed separately for low beam light and high beam light with the aid of numerous measurement points. Alongside prescribed illuminances of the low beam light impinging on the road, that is to say below the so-called light/dark boundary, there is also a need to meet special requirements above the light/dark boundary. This area of the light distribution is denoted as overhead or sign light area, the latter term being derived from the visibility of traffic signs. The legal measuring points of the so-called overhead light extend up to four degrees above a line that marks the horizon, and are characterized by minimum values and maximum values of the lighting intensities permissible there.

In the case of reflection systems, the measuring points can be very easily catered for with minimum values by a suitable shaping of the reflector. Projection systems with a low beam light function light the area above the light/dark boundary only very weakly, because of their optical principle. Consequently, it is necessary in the case of these projection systems to take measures to meet the minimum values of the intensities in this area. This can be achieved, on the one hand, by means of additional, reflecting components in the projection system such as, for example, reflecting diaphragms. Thus, it is known to make use of additional sheets that are arranged horizontally in the beam path and are strongly reflecting at high incidence angles. Said additional sheets constitute an additional component and therefore undesirably cause higher costs and a greater system complexity.

Other solutions provide a local change in geometry within the projection lens that exerts a suitable prismatic effect on a portion of the light flux penetrating through the lens.

The vehicle headlamp disclosed in utility model G 90 00 395.0 has an imaging optics with a lens and a diffusion lens that serves well as transparent cover of the vehicle headlamp. In order to suppress a color fringe, the light exit boundary surface of the lens is divided horizontally into an upper aspheric segment and a lower aspheric segment. At the transition between the two segments, the lens has a part of a horizontally arranged convex cylindrical lens. This cylindrical lens upwardly deflects the portion of the lens light flux that penetrates the cylindrical lens into a defined angular range such that this deflected light flux lights the overhead area.

In the case of another configuration, a sector of a horizontally arranged concave cylindrical lens is integrally formed on the light entrance boundary surface of the diffusion lens. This cylindrical lens likewise directs upward the partial light bundle traversing it. A further configuration specifies that it is also possible to provide a plurality of cylindrical lenses one above another vertically on the diffusion lens. The overall aim in the case of the known vehicle headlamp is to enable the upwardly deflected partial light bundle to fulfill legally required light values for fog lamps above the light/dark boundary.

Further examples of local deformations of the lens surface of the projection lens which, owing to their additional prismatic action, deflect light into measuring points within an overhead area are disclosed in the publications DE 10 2004 024 107 A1 and U.S. Pat. No. 6,971,778. DE 10 2004 024 107 A2 discloses for this purpose a lens with a cylindrical section running horizontally in the middle. U.S. Pat. No. 6,971,778 exhibits in this context a local depression in the lower region of the lens. Also known are geometric surface modifications which, however, do not primarily aim at producing defined overhead intensity values. These include, for example, lenses with horizontally and obliquely running corrugated structures. Such a lens is disclosed in DE 40 31 352 A1.

A great disadvantage of the known solutions, which operate with a local deformation of the lens surface, resides in the fact that they all react sensitively to even a slight change in the light distribution. Consequently, given the occurrence of a series of manufacturing tolerances, markedly altered illuminances can occur in the range of the sign-light measured values. The consequence is that it cannot be ensured that an overhead solution can be used on another projection system (that is to say in the event of a change in light distribution). This means, in turn, that it is necessary as a rule to find for each projection module new solutions to the production of the prescribed overhead lighting intensity values.

It is also disadvantageous that the required prismatic action always constitutes a clearly visible incursion into the lens surface that marks its appearance. In the case of previously disclosed solutions, this is partly felt as unaesthetic, or the local deformations are perceived as defects in the projection lens. Thus, various overhead solutions are perceived as conchoidal fractures (instances of splitting), glass defects such as inclusions and bubbles or visible jumps in the lens (for example in the case of horizontally arranged cylindrical lens sectors)—all of these being typical of glass.

BRIEF SUMMARY OF THE INVENTION

Against this background, the object of the invention is to specify a vehicle headlamp of the type named at the beginning in the case of which the desired deflection of light into the overhead area lying above the light/dark boundary reacts less sensitively to slight changes in the light distribution, and which is, moreover, not falsely perceived as defective by the final customer.

This object is achieved with the aid of the features of claim 1. As in the case of the prior art, the overhead lighting is obtained by the light-deflecting, and thus prismatic action of local deformations. In contrast to the prior art, where use is made only of cylindrical lenses that are large or less so, are respectively coherent and traverse the entire lens surface, the invention provides a distribution of the deflecting structures over more than 100 overhead elements, and their discrete arrangement, that is to say one in which they are respectively spatially separated from one another, on a boundary surface through which the light flux moves. There can also be more than 1000 overhead elements. The number of the overhead elements is therefore higher by one to three powers of ten than in the case of the prior art. Each individual overhead element can therefore turn out to be correspondingly smaller. The subjective impression of a lens defect is avoided owing to the reduction and the discretely distributed arrangement. Moreover, production tolerances in the dimensions of the individual overhead elements do not have such a disturbing effect as in the case of the prior art. The overhead light is lent a lesser sensitivity to these tolerances by the large number of the overhead elements.

These desired effects are additionally amplified by an arrangement of the overhead elements in a uniform distribution on the boundary surface. The uniform distribution can relate to subregions of the boundary surface, or else to the entire boundary surface. In other words, the uniform distribution of the overhead elements also lends the overhead light a lesser sensitivity to these tolerances.

It is preferred for the overhead elements to be distributed over the entire light exit surface. It is also preferred for the overhead elements to be aligned perpendicularly with respect to the boundary surface in such a way that the resulting deflection angles in the light are the same relative to the optical axis for each overhead element.

The particularly high insensitivity achieved in the case of a uniform distribution of identically shaped overhead elements with respect to changes in the light distribution yields not only an increased insensitivity to manufacturing tolerances, but also yields a further-reaching ability to use the structured boundary surface in projection systems of other vehicle headlamps such that a reliable boundary surface design can be used without complicated changes in the case of other vehicle headlamps.

Overall, in each case on their own and in combination with one another these features render it possible to produce an overhead lighting in a defined way. The sign-light values produced can be set in a way defined by number, area and geometry of the overhead elements, and can be effectively accessed for simulating dimensioning.

It is preferred in this case for the sum of the areas of the overhead elements of a boundary surface to have a value of between five percent and ten percent of the value of the boundary surface. The legal stipulations can be fulfilled by this dimensioning.

A further advantage of the uniform distribution resides in the fact that the latter is compatible with other uniform structurings of the boundary surface. Such a periodic structuring serves the purpose, for example, of making a light/dark boundary often felt to be acutely disturbing in the case of projection systems appear less sharply defined, that is to say appear to have a more continuous transition of the light intensity between the light and the dark areas. The overhead elements presented in this application can be embedded periodically in a periodic microstructure, it being preferred to provide in each case rounded transitions between elements of the microstructure and the overhead elements. The rounded transitions are preferably fashioned such that, to use mathematical terminology, they can be continuously differentiated at least once. This applies analogously for configurations without a microstructure, in the case of which the overhead elements merge in rounded fashion into the remaining boundary surface.

Disturbing optical effects are avoided because of the result that the surface is free from edges. Moreover, the production of tools with which the boundary surfaces are produced is simplified and the service life of the tools is lengthened.

Further advantages follow from the subject matters of further dependent claims, the description and the attached figures.

It goes without saying that the features named above and still to be explained below can be used not only in the respectively specified combination, but also in other combinations or on their own without departing from the scope of the present invention.

DETAILED DESCRIPTION OF THE INVENTION

Figure 1:
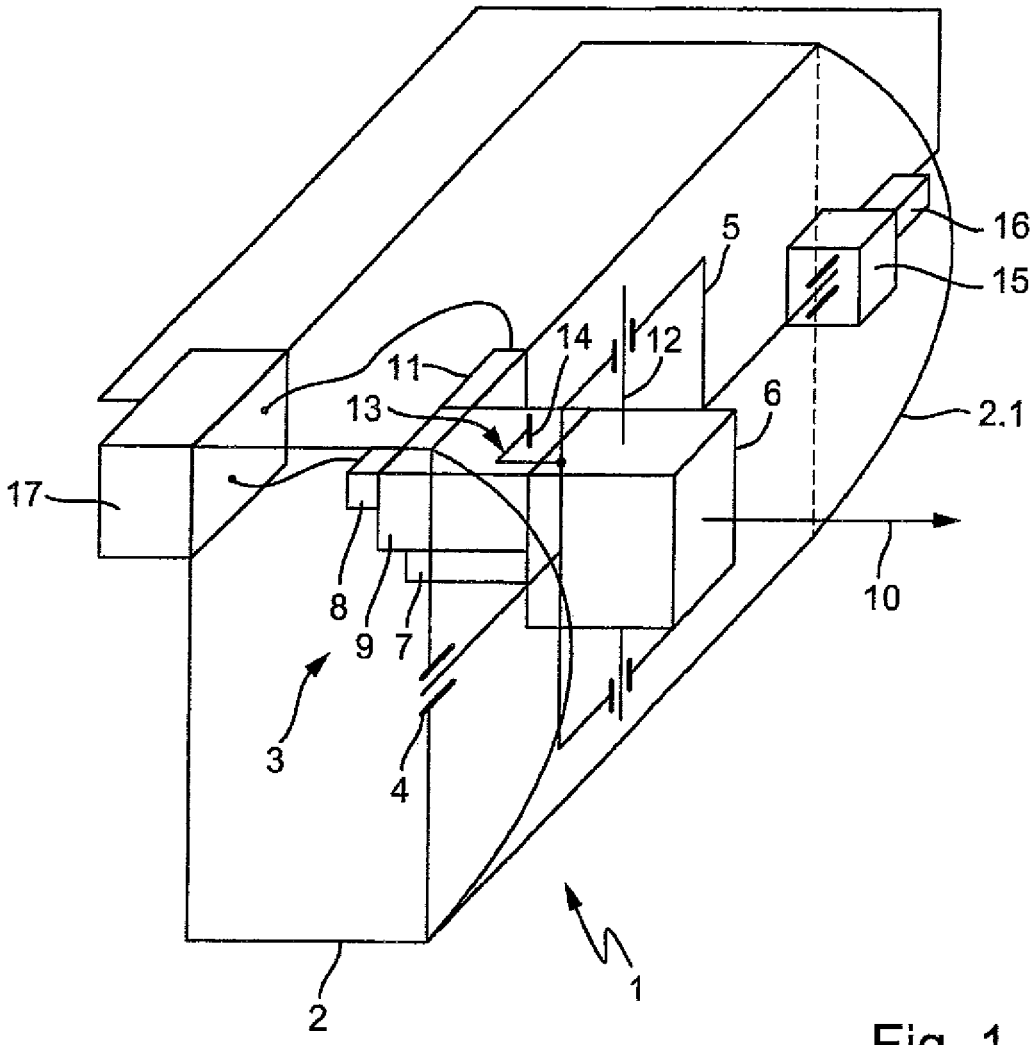
FIG. 1 shows a vehicle headlamp as technical field of the invention.

In detail, FIG. 1 shows a vehicle headlamp 1 with a housing 2 illustrated as a cuboid, a transparent cover pane 2.1, at least one control unit 17, and a bend light module 3 that can be pivoted about a horizontal axis 4 in the housing 2.

The bend light module 3 has a support frame 5, a light module 6, a first control unit 7, a first motor 8 and a gearbox 9 which, together, form an assembly. Here, the light module 6 is mounted in the support frame 5 such that it can rotate about a vertical axis. Motor 8 and gearbox 9 are connected, on the one hand, to the stationary support frame 5 and, on the other hand, to the light module 6, and are thus capable of exerting an adjusting torque between support frame 5 and light module 6.

The light module 6 has at least one light source and an optical element, such as a lens, that focuses the light flux of the light source, which is collected by a reflector or a primary optics, and directs it along a lighting direction 10 into the area in front of the vehicle headlamp 1.

The light source is preferably a gas discharge lamp, for example a xenon lamp, a semiconductor light source, for example an arrangement of light-emitting diodes (LEDs), or a halogen lamp.

The at least one light source is situated approximately at the first focal point of an ellipsoidal reflector. So-called polyellipsoidal reflectors are preferred. The diaphragm, which is imaged by the lens, is located approximately at the second focal point of the reflector. The lens images the diaphragm upper edge on the roadway. The optical axis of the light module corresponds to the optical axis of the lens. The focal points of the ellipsoidal reflector lie on the optical axis of the light module. The object focal point of the lens is situated in the region of the diaphragm. The light distribution can be influenced by varying the diaphragm upper edge.

Particularly in conjunction with semiconductor light sources, alongside said elliptical reflectors use is also made of transmitting systems in which the light is focused at the second focal point by refraction, but also partly by total internal reflection (attachment optics).

The reflector and the attachment optics are denoted below as primary optics, and the lens as secondary optics.

Low beam lighting systems of long range (illuminance) and low counter-traffic dazzling can thereby be illustrated. The secondary optics is preferably designed as an individual aspheric lens with focal lengths of between 40 mm and 75 mm. For technical lighting reasons, the lenses can have at least partially a regularly or irregularly structured surface. These structures have a height of approximately 3 μm-30 μm in relation to the base surface of the lens, and serve to influence brightness gradients of the light/dark boundary and/or to influence color effects in the imaging of the diaphragm upper edge. Irregular structures are comparable to the surface of an orange peel. However, random structures such as can be produced, for example, by sandblasting or shot peening are also possible. These structures constitute an effective but less flexible method for influencing said properties.

A targeted setting of the light/dark boundary can be achieved with a periodic array, at least partially covering the aspheric surface of the lens, of identical or similar individual optical elements. In particular, the light/dark boundary can be influenced in a targeted fashion by a suitable surface of the structural elements. These elements are described in the as yet not disclosed DE 10 2008 023 551 of the applicant.

Said structures can now be combined with the overhead elements. By means of an appropriate configuration of the structural elements, the overhead elements can replace a portion of the regular structural elements.

For the purpose of aligning the lens correctly in rotary fashion, markings are introduced at the lens edge, or else positive codings with the lens holders.

Various diaphragm mechanisms can be used in order to produce various light distributions such as, for example, low beam light, high beam light, town light, rain light etc. By way of example, switching over between low beam light and high beam light can be achieved with the aid of a folding diaphragm in the case of which the high beam light distribution is achieved by folding the diaphragm about a horizontal axis that runs perpendicular to the driving direction. In a preferred design, use is made of a diaphragm roller that is mounted so as to rotate about an approximately horizontal axis and has various contours on its periphery which, when projected onto the road by the secondary optics, can form various light/dark geometries. An alternative refinement provides a diaphragm arrangement with one or more diaphragm elements that are adjustably mounted in a vertical or in an approximately vertical direction. These diaphragms can be vertically adjusted via a second motor 11 and a gearbox in conjunction with slotted link guide or cam plate gear mechanisms. The gearbox can be the gearbox 9 or a separate gearbox.

The various positionable diaphragms produce different light/dark geometries that are projected by the secondary optics onto the road, it being possible as a result to provide different low beam light functions. In a preferred design, parts of the slotted link guide or cam plate gear mechanisms are integrally formed directly on the diaphragms: for example, slotted guide curves, cams or rollers.

If a gas discharge lamp or a semiconductor light source is used as light source, it is possible to provide a control unit, for example the control unit 7, to control the energy supply of these light sources. As an option, the control unit 7 can also include electronic elements for the electric drive of the motors 8 and/or 11 and 16.

The light module 6 is mounted in the support frame 5 such that it can pivot about a vertical axis 12. In the refinement illustrated, a pivoting movement is driven by the first motor 8 via a horizontal pivoting mechanism, arranged in the gearbox 9, and a lever mechanism 13 that couples a drive shaft 14.1 of the horizontal pivoting mechanism to the support frame 5. It holds overall that the light module 6 and the support frame 5 are coupled by motor via the first motor 8 and via the gearbox 9.

The support frame 5 is, for its part, connected in a fashion secure against rotation to the horizontally running axis 4, which is actuated in the schematic refinement illustrated via a vertical pivoting mechanism 15, fitted outside on the housing 2, and a third motor 16. The three motors 8, 11 and 16 are preferably electric motors, in particular stepping motors, and are actuated by one of the control units 7 or 17.

The light module 6 therefore has a universally joined suspension. It is preferred in this case for the point of intersection of the pivot axes to lie at the center of the envelopes of the outer contour of the lens.

The first motor 8 is driven to pivot the light module 6, and thus the lighting direction 10, in a horizontal direction. In a preferred refinement, the motor 8 is controlled by the control unit 17 as a function of a steering angle of steerable wheels of the motor vehicle such that the lighting direction 10 follows the steering angle of the steerable wheels. The drive of the third motor 16 varies a vertical component of the lighting direction 10 and serves, for example, to control the lighting range.

Figure 2:
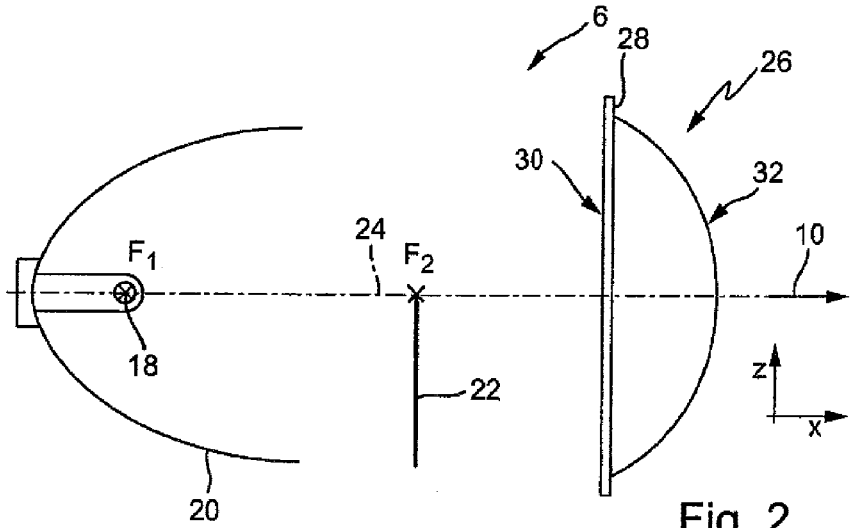
FIG. 2 shows an illustration of a refinement of a light module of the vehicle headlamp according to FIG. 1, in a longitudinal section.

FIG. 2 is a schematic of a refinement of the light module 6 in a longitudinal section. The light module 6 has a light source 18 for emitting light beams, and a reflector 20 for reflecting at least a portion of the emitted light beams. The reflector 20 is preferably formed as an ellipsoid of revolution, or an ellipsoidal freeform deviating therefrom. The light source 18 is arranged at a first focal point $F_1$ of the reflector 20. A diaphragm arrangement 22 shields at least a portion of the light flux emanating from the reflector 20. The diaphragm 22 is preferably arranged in a plane that runs perpendicular to an optical axis 24 and through the second focal point $F_2$ of the reflector 20.

A lens 26 is fastened on a front edge of the reflector 20 by means of a lens holder (not illustrated) acting on a collar 28. The lens 26 consists of any desired optically transparent material, for example of a thermally stable plastic or glass, and has a substantially flat light entrance boundary surface 30 on the side facing the light source 18, and a convex light exit boundary surface 32 on its opposite side. Of course, the boundary surface 30 can also be of concave or convex design.

The light module 6 serves to produce a light distribution with a light/dark boundary, preferably a low beam light distribution or a fog light distribution. The light/dark boundary is produced as a projection of the upper edge of the diaphragm arrangement 22 in the light distribution produced on the roadway by the light module 6. The direction x is substantially parallel to the direction 10 of the light flux and, when the headlamp 1 is installed, parallel to the longitudinal axis of the vehicle. The z-direction is parallel to the vertical axis of the vehicle and points upward. The y-direction is correspondingly perpendicular to the plane of the drawing, and points into the latter.

Figure 3A:
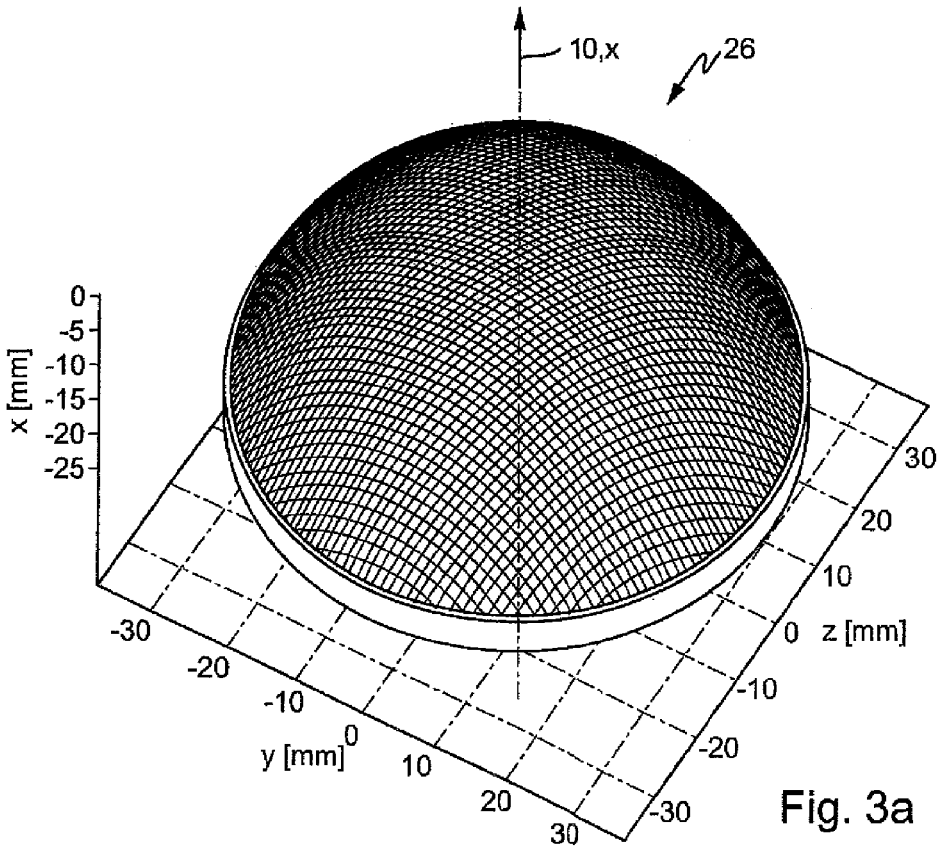
FIG. 3 shows various views of an optical lens of the light module from FIG. 2 with an exemplary embodiment of the invention.
Figure 3B:
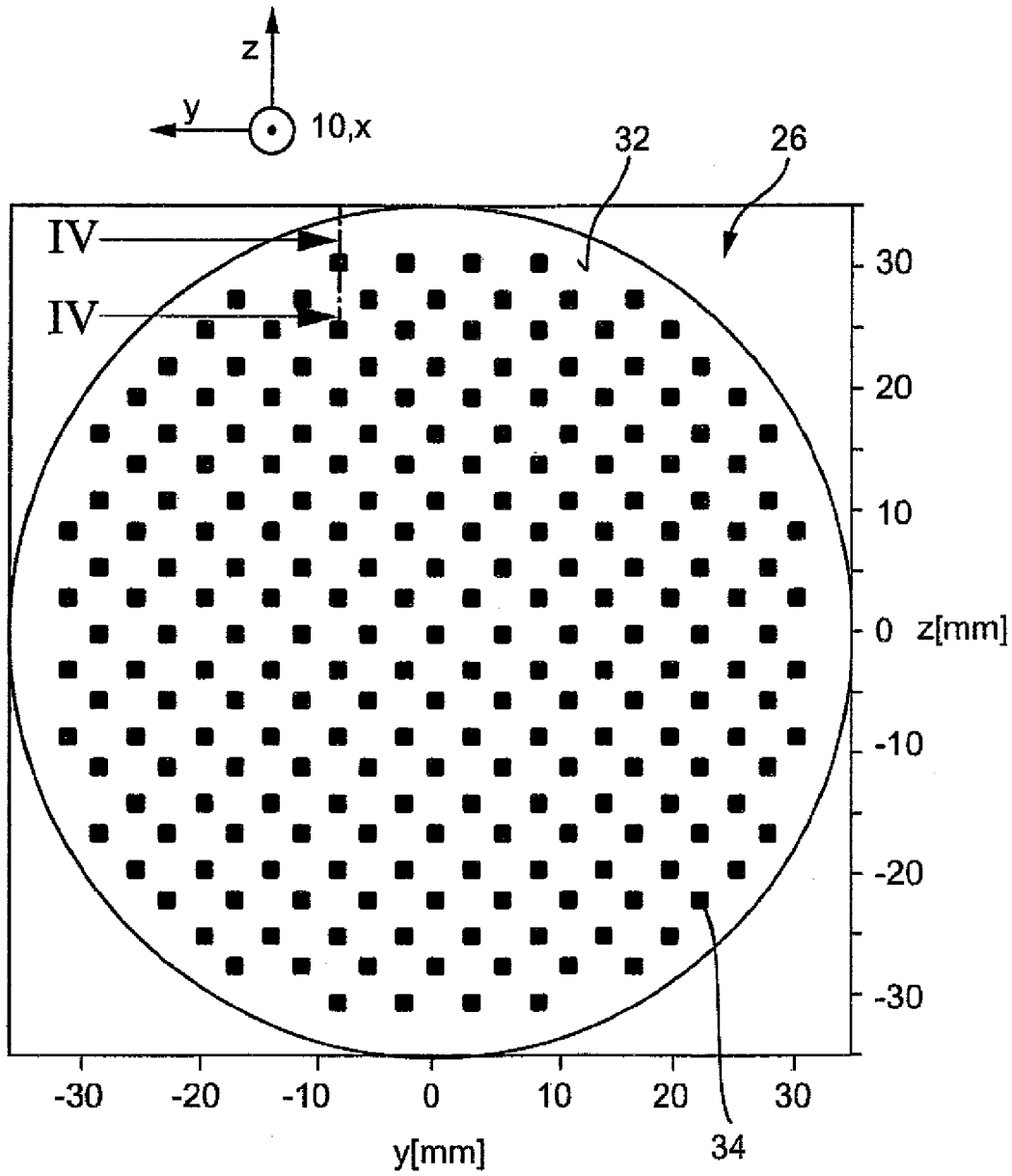

The optical lens 26 is illustrated in a perspective view in FIG. 3*a*, and in a plan view in FIG. 3*b*. It goes without saying that the numerical values specified in millimeters [mm] on the x-, y- and z-axes are given merely as examples and are in no way to be understood as restrictive.

FIG. 3*b* shows a plan view, taken against the light exit direction 10, of the light exit boundary surface 32 of a lens 26 that has more than one hundred overhead elements 34 distributed discretely over the boundary surface 32. In the refinement illustrated, approximately two hundred and twenty such overhead elements 34 are distributed uniformly over the boundary surface 32. Here, a uniform distribution is understood as a distribution in the case of which the projections of the overhead elements in the y-z-plane form a periodic twodimensional lattice structure. The overhead elements appear equally large in this projection.

FIG. 3*b* shows a refinement in the case of which the overhead elements 34 are distributed over the entire light exit boundary surface 32 of the lens 26. It is also possible to undertake a uniform distribution only in a subregion, for example in a circle that is concentric with the periphery of the lens 26 and has a smaller radius. In principle, the overhead elements 34 can, however, be arranged in various arrangements, for example in concentric circles, spirals, rhombuses, triangles or other patterns such as logos. Furthermore, for the purpose of deflecting the light, the individual overhead elements 34 can be arranged in simple Cartesian grids, or Cartesian grids lying one over another in offset fashion, said grids being of different spatial frequency.

The visual appearance can be adapted by the arrangement to the subjective aesthetic notions. The quantity of the overhead light produced is set by varying the packing density, the size and the shape of the individual overhead elements 34. In any case, it is essential to the arrangement that the individual overhead elements 34 be aligned relative to one another such that they deflect the light in the same directions in each case. It is also preferred to this end that the individual overhead elements 34 have the same shape and, if appropriate, additionally the same dimensions, that is to say are the same as one another. The summed area of the overhead elements 34 is preferably five percent to ten percent of the lens boundary surface 32.

Figure 4:
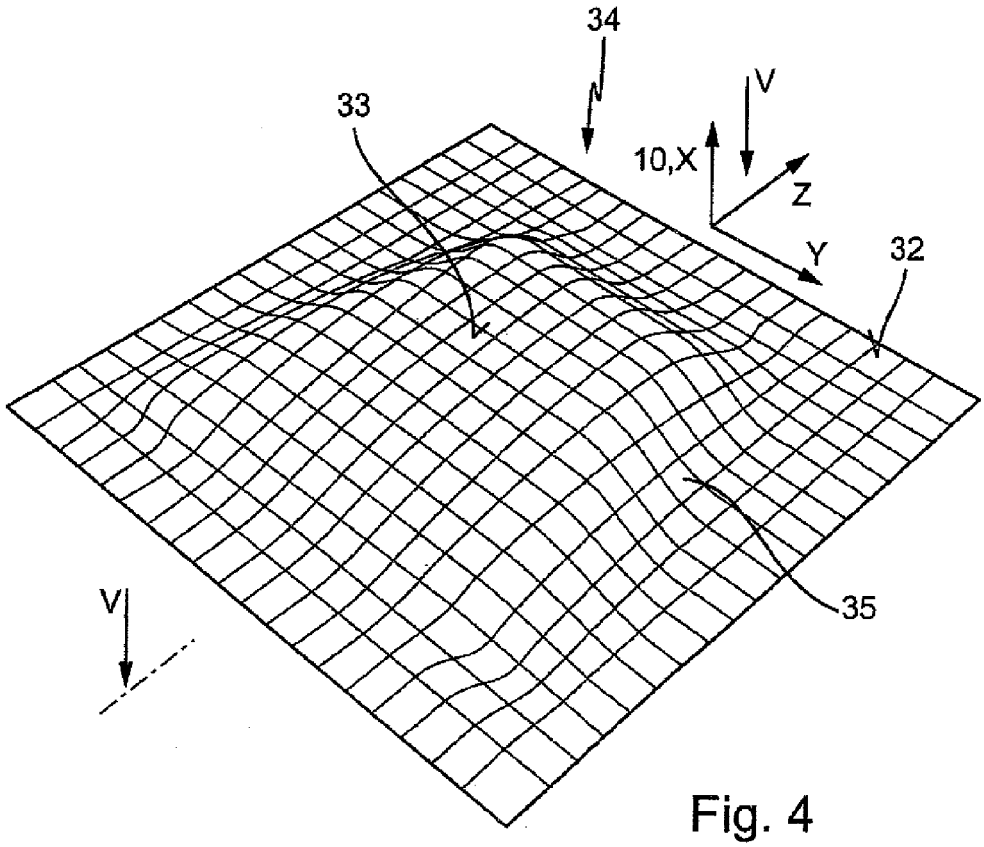
FIG. 4 shows a perspective view of an individual overhead element of the lens from FIG. 3.

FIG. 4 shows a refinement of an overhead element 34 in a perspective illustration. The illustrated overhead element 34 rises out of the remaining boundary surface 32. The height of the bump over the remaining boundary surface 32 is preferably 3% to 15% of the vertical extent (length) of an overhead element. The vertical extent or length of the overhead element is understood here as the spacing of the points 38 and 40 in FIG. 5. Given the preferred dimensions of 0.5 to 4 mm, bumps of 15 micrometers to 0.6 mm are obtained. The height to be selected is also a function of the refractive index of the lens. The larger the refractive index, the smaller the height will be. As is to be seen from FIG. 4, the lifted out overhead element 34 respectively merges in rounding off fashion into the remaining boundary surface 32, and so no edges are produced between the boundary surface 32 and the overhead element 34 projecting therefrom in the light exit direction 10.

Various rounding surfaces defined by mathematical functions can be used for the rounding off, for example surfaces defined by spline functions. Rounding surfaces defined in other ways are also possible. It is essential in each case that no edge be produced.

A plan view of the overhead element 34 illustrated in FIG. 4 reveals a trapezoidal basic shape of the bump. The width of the overhead element 34 in the y-direction decreases with increasing extent in the z-direction.

The overhead element 34 is implemented as a tilting of a subregion of the boundary surface 32 relative to the remaining boundary surface 32. This tilting results in the desired prismatic, that is to say light-deflecting effect with which the overhead illumination is produced. In one refinement, the tilted sections are square; however, they can also have another shape, for example said trapezoidal shape. It is also preferred for the tilting of the surface not to be constant within an overhead element 34, but for it to vary in the z-direction. The degree of the tilting influences the angle by which the light is deflected. The variation of this angle results in an illumination of the entire overhead measuring range in which it is necessary to reach and/or fall below prescribed intensities at prescribed measuring points. The result is thus a light band above the light/dark boundary that is lit continuously over its area. Since the extent of the tilting determines the deflection angle and since, at a specific tilt angle, the width of the overhead element 34 influences the quantity of the light deflected by the associated deflection angle, the quantity of the light deflected in specific directions can be controlled by varying the width as a function of the tilt angle. It can therefore be advantageous also to use other shapes than squares for the plan view of the overhead elements.

In a preferred refinement, the tilted region of the surface sections is implemented by cylindrical sections or toric surface elements. Alternatively, however, it is also possible to use spline functions or comparable mathematical functions or a combination of such functions.

Overall, FIG. 4 therefore shows in particular a refinement of an overhead element that consists essentially of a main deflecting surface 33 tilted out of the boundary surface 32 of the lens and, respectively, of at least three surfaces 35 tilted in another direction. Here, a tilted surface pointing in the positive y-direction is denoted by the reference numeral 35. In the refinement illustrated, another tilted surface points by way of example in the negative y-direction, while yet a further tilted surface points by way of example in the positive z-direction. All three surfaces 35 tilted in another direction merge continuously into the main deflecting surface 33 and the boundary surface 32. It is preferred in this case for the surfaces respectively to merge into one another in a continuously differentiable fashion. In one refinement, a base surface of the lens having no bumps or depressions is regarded as boundary surface. Alternatively, however, it is also possible to regard as boundary surface a boundary surface having other bumps and/or depressions such as is used, for example, to reduce the contrast of a light/dark boundary.

Figure 5:
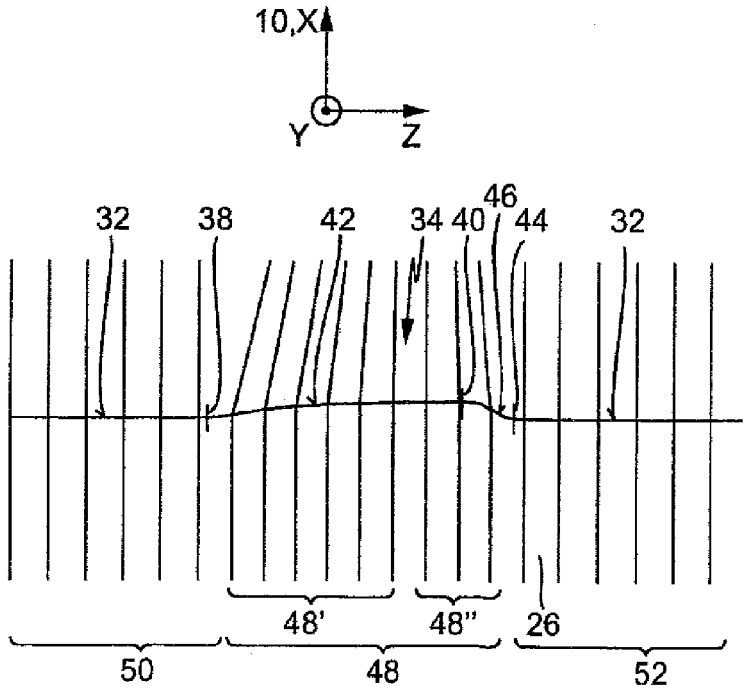
FIG. 5 shows a cross section of such an overhead element in conjunction with a light flux.

FIG. 5 shows a cross section through the overhead element 34 of FIG. 4 along the line VV in FIG. 4. The cross section of the overhead element 34 is divided into a first section 42, which is situated between the points 38 and 40, and a second section 46 that is situated between the points 40 and 44. Here, the vertical extent or length of the overhead element is understood as the spacing of the points 38 and 40 in FIG. 5. The curvature of the first section 42 corresponds in a preferred refinement to the curvature of a lateral cylinder surface. The surface, associated with the section 42, of the overhead element 34 corresponds to a portion of a lateral surface of an imaginary cylinder whose axis is situated parallel to the base surface of the vehicle within the lens 26 when the headlamp 1 is installed in the vehicle. Alternatively, the contour 42 can also be produced as a spline function or as a comparable mathematical function or as a combination of such functions. What is essential in each case is the continuously differentiable profile for a curvature that is variable in the z-direction.

The first section 42 produces the desired low beam effect. Section 46 serves only to implement a continuously differentiable, and thus edgeless transition between the first section 42 of the overhead element 34 and the remaining boundary surface 32 of the lens 26.

The desired deflecting effect is made clear by comparing the light bundle 48, which penetrates the boundary surface of the lens 26 in the region of the overhead element 34, with the light bundles 50, 52 which penetrate through regions of the boundary surface 32 which are adjacent to the overhead element 34. By comparison with the deflection of the light bundles 50 and 52, which is absent or only comparatively weak, upon penetration through the boundary surface 32, a portion 48' of the light bundle 48 experiences a comparatively stronger deflection in the z-direction. Owing to the comparatively stronger deflection, the light bundle 48' is deflected beyond the light/dark boundary, while the portion 48" of the light bundle 48 is deflected into the low beam light distribution. The light bundles 50, 52 light the region below the light/dark boundary.

In accordance with the division of the surfaces of the overhead elements 34 and the remaining light exit boundary surface of the lens 26, five percent to ten percent of the light penetrating through the lens 26 is scattered into the overhead area, while the remaining ninety to ninety five percent serves to light the area beneath the light/dark boundary.

In a preferred refinement, a maximum deflection of a light beam 48, deflected by an overhead element 34, in relation to a neighboring light beam 50, 52 that is not deflected by the overhead element 34 is at least five degrees.

Up to here, the invention has been explained by way of example of a light exit boundary surface of a projection lens 26. Alternatively or in addition, the spatially selectively deflecting effect can, however, also be produced by appropriately configuring the light entrance boundary surface of the lens 26. In the case of vehicle headlamps, whose light module 6 cannot be pivoted, the deflecting effect can also be implemented, if appropriate, by distributing overhead elements over the light entrance the boundary surface of the cover pane. However, a solution is preferred in which the overhead elements are distributed discretely over the light entrance boundary surface or light exit boundary surface of the projection lens 26.

FIG. 6 shows a comparison of light distributions that result in the case of projector type vehicle headlamps with and without overhead elements. Such light distributions result, for example, on a surface arranged in front of the vehicle and aligned perpendicular to the vehicle longitudinal axis. The horizontal line HH marks the position of a horizon, while the vertical line VV divides the field of view of the driver approximately in the middle of the vehicle. Points that lie on the same curve are distinguished by a mutually identical lighting intensity. As regards a plurality of curves, the intensity decreases outward from inside.

Figure 6A:
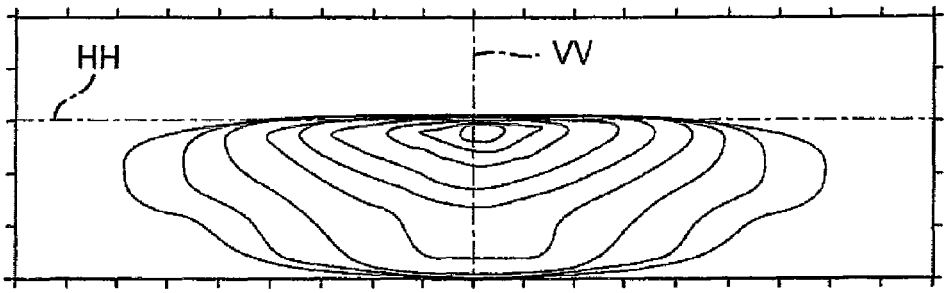
FIG. 6 shows light distributions that result in the case of a vehicle headlamp with and without the use of overhead elements.

FIG. 6*a* shows a typical low beam light distribution of a first projector type vehicle headlamp without overhead elements. The lighting intensities are concentrated substantially on the area below the horizon HH.

Figure 6B:
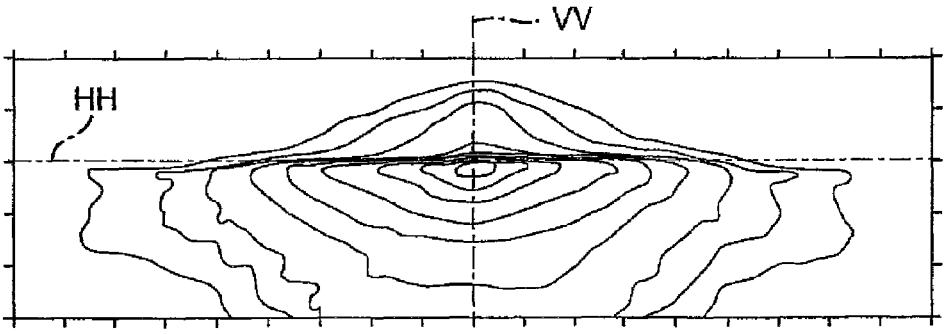

By contrast, FIG. 6*b* shows a typical light distribution such as is obtained with a second headlamp that differs from the first projector headlamp only by a lens 26 provided with overhead elements of the type presented here. The lines of equal lighting intensity that bulge outward and upward beyond the horizon represent the desired overhead lighting in FIG. 6*b*. This overhead lighting, which is known per se, can be set with the aid of the invention with the advantages, presented further above, of the insensitivity to changes in the fundamental light distribution and the improved appearance.

The invention claimed is:

1. A vehicle headlamp, comprising;

a light source emitting a light flux;

an imaging optics projecting the light flux into an area in front of the vehicle headlamp;

a diaphragm arranged between the light source and the imaging optics, the diaphragm having an edge that delimits the light flux of the light source of the vehicle headlamp creating a light/dark boundary of the light flux projected by the imaging optics;

a boundary surface of the imaging optics through which the light flux penetrates, the boundary surface having a plurality of overhead elements in the form of a local deformation of the boundary surface each having a prismatic effect by means of individual surfaces which deflect the light into an area lying over and below the light/dark boundary;

wherein each overhead element has at least one surface deflecting a first amount of the light over the light/dark boundary and one surface deflecting a second amount of the light below the light/dark boundary and the boundary surface has more than one hundred overhead elements distributed discretely over the boundary surface.

2. The vehicle headlamp as claimed in claim 1, wherein the overhead elements are distributed uniformly over the boundary surface.

3. The vehicle headlamp as claimed in claim 1, wherein the overhead elements are distributed over the entire boundary surface.

4. The vehicle headlamp as claimed in claim 1, wherein the overhead elements are superposed on a surface structure.

5. The vehicle headlamp as claimed in claim 1, wherein the overhead elements replace structural elements of a regular surface structure.

6. The vehicle headlamp as claimed in claim 1, wherein the overhead elements are the same as one another.

7. The vehicle headlamp as claimed in claim 1, wherein the proportion of the sum of the areas of the overhead elements of a boundary surface has a value of between 5% and 10% of the area of the boundary surface.

8. The vehicle headlamp as claimed in claim 1, wherein the overhead elements are implemented as bumps on the boundary surface.

9. The vehicle headlamp as claimed in claim 1, wherein the overhead elements rise 15 micrometers to 0.6 mm high over the undeformed boundary surface.

10. The vehicle headlamp as claimed in claim 1, wherein the surfaces of the overhead elements are implemented as tilting of subregions of the boundary surface in relation to the remaining boundary surface.

11. The vehicle headlamp as claimed in claim 10, wherein the imaging optics is a lens and each overhead element consists essentially of a main deflecting surface tilted out of the boundary surface of the lens and, respectively, of at least three surfaces tilted in another direction, the at least three surfaces tilted in another direction merging continuously into the main deflecting surface and the boundary surface.

12. The vehicle headlamp as claimed in claim 11, wherein the surfaces respectively merge into one another in a continuously differentiable fashion.

13. The vehicle headlamp as claimed in claim 10, wherein a base surface of the lens having no bumps or depressions is regarded as boundary surface.

14. The vehicle headlamp as claimed in claim 10, wherein the value of the area of a subregion is between a quarter of a square millimeter and three square millimeters.

15. The vehicle headlamp as claimed in claim 10, wherein the tilt angle between the surfaces of the tilted subregion and the neighboring untilted boundary surface varies within a subregion, said tilt angle decreasing along a direction (z) of a vertical axis for the headlamp installed in the vehicle.

16. The vehicle headlamp as claimed in claim 11, wherein the surfaces of the tilted subregions constitute parts of lateral surfaces of imaginary cylinders whose axes lie parallel to a base surface of the lens for the headlamp installed in the vehicle.

17. The vehicle headlamp as claimed in claim 1, wherein a maximum deflection of a light beam, deflected by an overhead element, in relation to a neighboring light beam that is not deflected by at least one of the plurality of the overhead element is at least 5°.

18. The vehicle headlamp as claimed in claim 1, wherein the boundary surface is a light exit surface of a lens or of a transparent cover pane of the vehicle headlamp.

19. The vehicle headlamp as claimed in claim 1, wherein the boundary surface is a light entrance surface of a lens or of a transparent cover pane of the vehicle headlamp.

* * * * *